United States Patent [19]

Johnson

[11] 3,942,219

[45] *Mar. 9, 1976

[54] VACUUM CLEANER HAVING EDGE CLEANING FEATURES

[75] Inventor: Robert Edward Johnson, St. Paul, Minn.

[73] Assignee: Whirlpool Corporation, Benton Harbor, Mich.

[ * ] Notice: The portion of the term of this patent subsequent to Feb. 10, 1993, has been disclaimed.

[22] Filed: June 3, 1974

[21] Appl. No.: 475,973

[52] U.S. Cl. ..... 15/383; 15/416

[51] Int. Cl.[2] ..... A47L 9/00

[58] Field of Search ..... 15/331, 416, 418, 383

[56] References Cited

UNITED STATES PATENTS

| | | | |
|---|---|---|---|
| 2,296,462 | 9/1946 | Betts | 15/416 X |
| 2,348,861 | 5/1944 | Smellie | 15/416 X |
| 2,953,808 | 9/1960 | Carmack | 15/416 X |

*Primary Examiner*—Daniel Blum
*Assistant Examiner*—C. K. Moore
*Attorney, Agent, or Firm*—Wegner, Stellman, McCord, Wiles & Wood

[57] ABSTRACT

A vacuum cleaner having edge cleaning features comprising a cleaner body with a floor contacting suction chamber and a suction duct leading from the chamber, an edge auxiliary cleaning chamber at one end of the suction chamber and communicating through a port with the suction duct, a valve within the cleaner body movable between open and duct restricting positions for selective full nozzle cleaning and edge cleaning with suction through the auxiliary cleaning chamber when the valve is open and operating means accessible from the exterior of the cleaner for the moving of the valve between said positions.

10 Claims, 4 Drawing Figures

VACUUM CLEANER HAVING EDGE CLEANING FEATURES

BACKGROUND OF THE INVENTION

1. Field of the Invention

This invention relates to vacuum cleaners and in particular to upright vacuum cleaner suction chambers.

2. Description of the Prior Art

In one conventional form of vacuum cleaner, a nozzle is provided at the end of a hollow tube, or wand, for applying suction to the surface to be cleaned and permitting dirt loosened from the surface to be sucked in by a stream of air drawn through the nozzle and tube to the dirt collecting receptacle of the vacuum cleaner. The conventional suction nozzle of this type is transversely elongated with the tube extending from the mid-portion thereof. Thus, in the conventional nozzle arrangement, maximum suction is applied at the mid-portion of the nozzle.

In another conventional form of vacuum cleaner a nozzle is provided with a motor driven rotary brush for agitating a carpet while applying suction to the surface to be cleaned and permitting dirt loosened from the surface to be sucked in by a stream of air drawn through the nozzle to the dirt collecting g receptacle of the vacuum cleaner. The conventional nozzle of this type includes brush bearings and brush drive mechanism at the opposite ends of the nozzle.

One of the deficiencies of the conventional nozzles is its inability to efficiently suck dirt at the opposite edges of the nozzle. This presents a vexatious problem where the unit is being utilized to clean a floor surface adjacent a wall or other upright obstruction. Thus, conventionally, resort is had to bringing the nozzle to adjacent the wall with the direction of elongation thereof parallel to the wall surface requiring substantial repeated manipulation of the vacuum cleaner to effect the desired cleaning of the floor surface adjacent the wall. Such repeated manipulation presents the further problem of potential damage to the wall surfaces as the nozzle must be brought repeatedly directly up to the wall in effectively cleaning the entire floor surface edge.

A number of different suction nozzle devices have been developed in an attempt to solve this vexatious problem. Thus, as shown in U.S. letters Pat. No. 1,782,882 of S. H. Rippey, the nozzle is provided with means defining conduits extending to the opposite ends of the nozzle with the flow of air through the conduits being selectively blocked by a manipulatable valve and with the center portion of the nozzle remaining open at all times.

In the subsequent U.S. letters Pat. No. 1,895,584 of D. B. Replogle, an air cleaning tool is provided with an end closure means which is movable as a result of a downward pressure on the nozzle adjacent the side wheels to provide a controlled flow of air through the end openings. The wheels in the Replogle structure are disposed outwardly of the opposite ends of the nozzle, thereby preventing disposition of either nozzle end directly at a wall.

In U.S. letters Pat. No. 2,555,979 of G. E. Loofgren, a suction nozzle is shown having a valve for concentrating air flow at the end of the nozzle by varying the amount of closure of the mid-portion of the nozzle. At no time is the entire nozzle open to the tube.

In L. A. Wolf U.S. letters Pat. No. 3,550,183, a vacuum cleaner cleaning tool is shown having passages leading to the front corners of the nozzle. No means is provided for selectively controlling the relative air flow between the different portions of the nozzle inlet opening.

In R. D. Hill et al U.S. letters Pat. NO. 3,377,647, a crack cleaning suction attachment is illustrated wherein an auxiliary suction duct is provided having a portion connected to the internal suction system of the vacuum cleaner and a forward end portion provided with a suction tip. Means are provided for removably mounting the suction tip at one side of the main suction head of the vacuum cleaner. The coupling portion is inserted through a valve port so as to open the normally closed port and permit suction to be applied through the attachment from the main suction fan means of the vacuum cleaner. Thus, both the main suction and auxiliary suction means have suction simultaneously applied thereto by the fan.

SUMMARY OF THE INVENTION

One of the features of this invention is to provide an improved vacuum cleaner having a normal surface contacting suction chamber and an edge auxiliary chamber, a suction duct leading from the chambers for removing dust laden air from the surface being cleaned, a valve located internally of the cleaner and movable between open duct and duct restricting positions for selective full nozzle cleaning and edge cleaning with suction being provided to the auxiliary chamber and suction chamber when the valve is open and full suction chamber flow when the valve is closed and operating means accessible from the exterior of the chamber for moving the valve between said positions.

DESCRIPTION OF THE PREFERRED EMBODIMENT

Figures 1, 2, 3, 4:
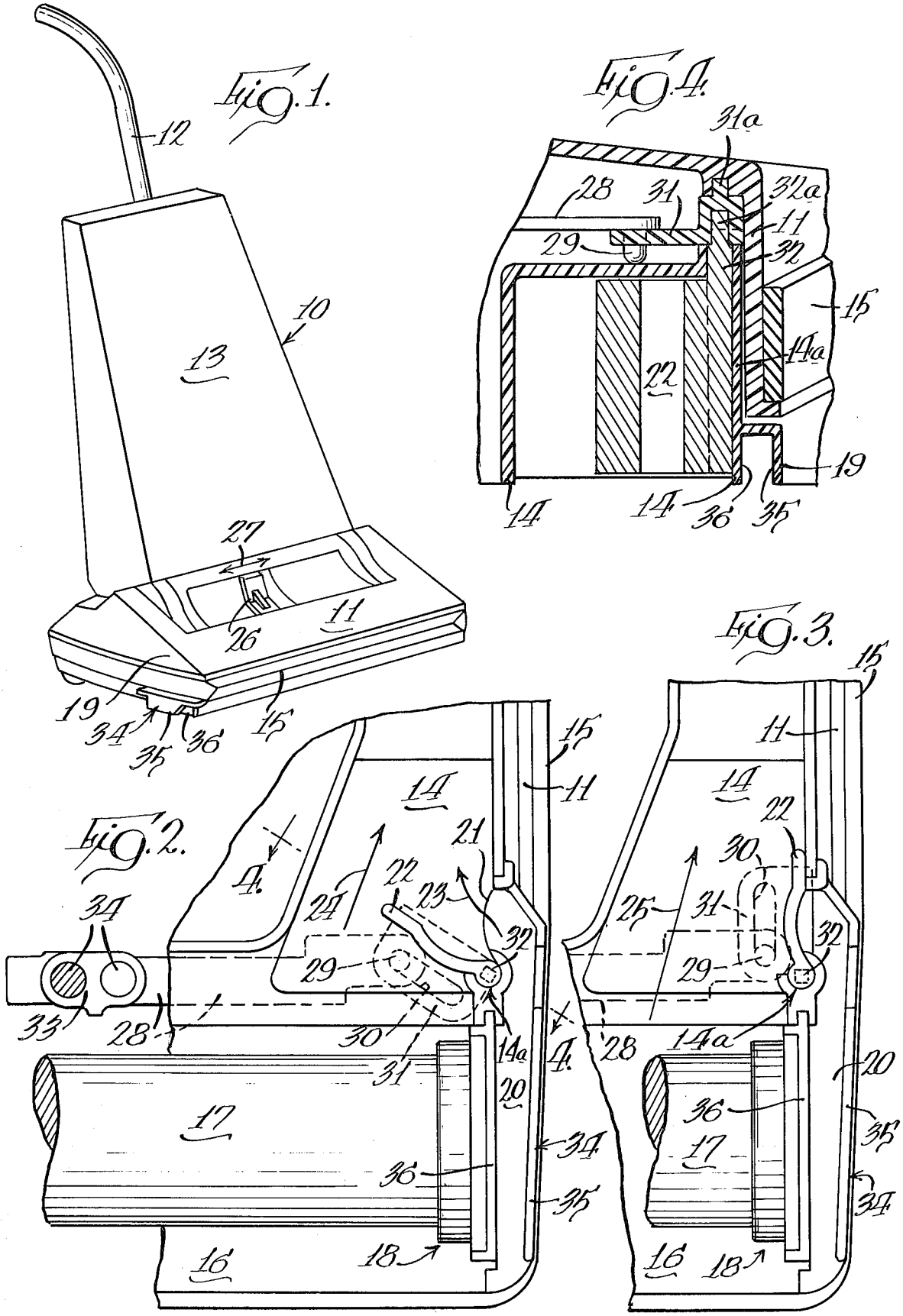
FIG. 1 is a perspective view of a vacuum cleaner embodying the invention.
FIG. 2 is a fragmentary bottom elevational view of the cleaner showing the bottom of the left-hand end of FIG. 1 with a flow control valve in full open position.
FIG. 3 is a view similar to FIG. 2 but showing the valve in full closed position.
FIG. 4 is a sectional view taken substantially along line 4—4 of FIG. 2.

In the illustrated embodiment the vacuum cleaner 10 is an upright model with a floor contacting cleaner body 11 adapted to be propelled over a floor in the usual manner by an upright handle 12. The cleaner also includes an upright container 13 in which is located the dirt separating member (not shown) which separates air from dirt in the dirt laden air stream driven upwardly by a suction means (not shown) through a suction duct 14, all in the normal manner. The cleaner body that is propelled over the floor being cleaned is provided with the usual peripheral resilient bumper 15.

Located within the forward suction chamber 16 is the customary driven carpet agitating brush which is shown schematically at 17 in FIGS. 2 and 3. The illustrated end of the brush 17 is rotatably supported in a bearing structure 18 in the customary manner. As is usual this brush is rotated by a motor drive which is not shown as it is not necessary in an understanding of the invention.

Positioned at the illustrated end of the suction chamber 16 or at the edge 19 of the cleaner body 11 is an auxiliary cleaning chamber 20 formed by a wall member 34 that in this invention is used for edge cleaning as along the edge of a room or other similar areas which are difficult to clean with an ordinary cleaner. This wall member 34 has walls 35 and 36 to provide the long and narrow edge cleaning chamber 20 as can be seen in FIGS. 2 and 3 with the narrow dimension being at the lateral edge 19 of the cleaner body. Wall 35 is positioned so as to divide chambers 20 and 16 and also to support bearing structure 18 of rotatable brush 17.

The rear end of the edge chamber 20 is provided with a port 21 so that when a valve, illustrated by the vane valve 22, is in the fully open position as shown in FIG. 2 it permits the free flow of air as illustrated by the arrow 23 from the edge chamber 20 into the suction duct 14 and at the same time provides somewhat restricted flow as illustrated by the arrow 24 from the main suction chamber 16 because the valve 22 when fully open extends partway across the duct 14. During edge cleaning this valving allows high suction in chamber 20 while the reduced suction in chamber 16 is sufficient to carry away any dirt that is dislodged by the rotating brush 17.

When the valve 22 is in the fully closed position across the port 21 as shown in FIG. 3 the edge cleaning chamber 20 is closed off so that the cleaner operates with full suction in the main front suction chamber 16 in the same manner as vacuum cleaners that do not have the edge chamber 20. This full air flow from the chamber 16 is illustrated by the arrow 25.

The vane valve 22 is pivotally mounted in duct 14 by means of a pivot pin 32 fitted in a bearing surface 14*a* of duct 14. In order to move the valve 22 between open and closed positions there is provided an operating means including a slidable knob 26 on the front of the cleaner and adjacent the edge 19 and a slidable link 28. This knob is slidable laterally or longitudinally as indicated in FIG. 1 by the arrow 27 and when moved fully to the right as illustrated operates through a link 28 to move the valve to the fully open position as shown in FIG. 2. This is accomplished by providing a pin 29 in the valve end of the link 28 that engages a slot 30 in a flange plate 31. The flange plate is pivoted about pivot pin 32 mounted in cleaner body 11. Link 28 is attached to knob 26 by means of a retainer 33 which snaps over projections 34 formed integrally with knob 26, thus holding link 28 between the retainer and knob. Vane valve 22 is connected to flange plate 21 at a squared end 32*a* of pivot pin 32 for movement therewith. As can be seen in FIGS. 2 and 3 the valve operating pin 29 is always rearwardly of the pivot pin 32 and is closest to the pin 32 when the valve is closed so that the lever 28 and pin 29 also function to hold the valve 22 tightly closed.

The selective edge cleaning structure of this invention permits selection of suction air flow at one edge of the cleaner nozzle structure in order to provide strong suction at this edge for facilitating the cleaning of hitherto difficult to reach edge areas. At the same time there is maintained a sufficient flow of air as shown by the arrow 24 toremove any dust and dirt that is dislodged by the rotating brush 17. All of the parts of this edge cleaning device except the operating knob 26 are on the interior of the cleaner body 11 and the knob can be operated either by hand or can be moved between its positions by the foot if desired. Thus the edge cleaning structure of this invention does not require assembling an external attachment as was previously necessary when an operator desired to clean along a wall or other edge area that is otherwise difficult to reach.

Having described the invention, the embodiments of the invention in which an exclusive property or privilege is claimed are defined as follows:

1. A vacuum cleaner having edge cleaning features, said vacuum cleaner comprising: a cleaner body having a surface contacting suction chamber, a suction duct leading from said chamber, and an edge auxiliary cleaning chamber at an end of said suction chamber communicating through a port with said suction duct; an internal valve movable between open and closed positions for controlling air flow both from said suction chamber and auxiliary cleaning chamber to said duct; means for limiting the movement of said valve to provide when said valve is in the open position maximum air flow through said auxiliary chamber for maximum edge cleaning and limited substantial air flow through said suction chamber for limited center cleaning, and provide when said valve is in the closed position no air flow through said auxiliary cleaning chamber and full air flow through said suction chamber for maximum center cleaning; and operating means accessible from the exterior of said cleaner for selectively moving said valve to said open and closed positions.

2. The vacuum cleaner of claim 1 wherein said valve when in said open position extends partway across said duct.

3. The vacuum cleaner of claim 1 wherein said valve is a vane valve hingedly mounted to said body at one edge of said suction chamber.

4. The vacuum cleaner of claim 1 wherein said operating means comprises a slidable knob exteriorly of said cleaner body and a slidable link interconnecting said knob and said valve.

5. The vacuum cleaner of claim 1 wherein said valve is a vane valve hingedly mounted to said body at one edge of said suction chamber, and said operating means comprises a slidable knob exteriorly of said cleaner, a flange plate connected to said valve, and a slidable link interconnecting said knob and said valve through said flange plate.

6. The vacuum cleaner of claim 5 wherein said flange plate is connected to said valve at substantially right angles thereto and has a slot engaged by a pin on said link for moving said valve arcuately when said link is moved longitudinally.

7. A vacuum cleaner having edge cleaning features, said vacuum cleaner comprising: a cleaner body having a surface contacting suction chamber and a suction duct leading from said chamber; a rotatably driven brush positioned in said suction chamber for agitating the surface to be cleaned; means defining an edge auxiliary cleaning chamber at an end of said suction chamber communicating through a port with said suction duct; an internal valve movable between open and closed positions for controlling flow both from said suction chamber and auxiliary cleaning chamber to said duct; means for limiting the movment of said valve to provide when said valve is in the open position maximum air flow through said auxiliary chamber for maximum edge cleaning and limited substantial air flow through said suction chamber for limited center cleaning, and provide when said valve is in the closed position no air flow through said auxiliary chamber and maximum air flow through said suction chamber for maximum center cleaning; and longitudinally movable operating means accessible from the exterior of said cleaner for selectively moving said valve to said open and closed positions.

8. The vacuum cleaner of claim 7 wherein there is provided a flange plate connected to said valve and having a slot, a pin on said operating means received in said slot for pivoting said valve as an incident of said operating means being moved longitudinally.

9. The vacuum cleaner of claim 8 wherein said valve is mounted on a pivot carried by said body and said operating means pin is juxtaposed to said pivot when the valve is in the closed position.

10. The vacuum cleaner of claim 7 wherein said valve is arranged to maintain approximately one-half the flow path from said suction chamber to said duct in an unobstructed condition in said open position.

* * * * *